US006701820B2

(12) United States Patent
Fluhr

(10) Patent No.: US 6,701,820 B2
(45) Date of Patent: Mar. 9, 2004

(54) METHODS AND APPARATUS FOR FASTENING A SILENCER ONTO THE BARREL OF A FIREARM

(75) Inventor: Norbert Fluhr, Oberndorf (DE)

(73) Assignee: Heckler & Koch, GmbH, Oberndorf (DE)

( * ) Notice: Subject to any disclaimer, the term of this patent is extended or adjusted under 35 U.S.C. 154(b) by 0 days.

(21) Appl. No.: 10/193,797

(22) Filed: Jul. 12, 2002

(65) Prior Publication Data

US 2003/0019351 A1 Jan. 30, 2003

Related U.S. Application Data

(63) Continuation-in-part of application No. PCT/EP00/12305, filed on Dec. 6, 2000.

(30) Foreign Application Priority Data

Jan. 14, 2000 (DE) ..... 100 01 374

(51) Int. Cl.[7] ..... F41A 21/30
(52) U.S. Cl. ..... 89/14.4
(58) Field of Search ..... 89/14.4

(56) References Cited

U.S. PATENT DOCUMENTS

| | | | | |
|---|---|---|---|---|
| 984,750 A | * | 2/1911 | Craven | |
| 1,127,250 A | * | 2/1915 | Humm | |
| 1,354,416 A | | 9/1920 | Oliver | |
| 2,101,849 A | | 12/1937 | Green | 89/14 |
| 4,384,507 A | * | 5/1983 | Finn | |
| 4,429,614 A | | 2/1984 | Tocco | 89/14 C |
| 4,510,843 A | * | 4/1985 | Rabatin | |
| 4,530,417 A | | 7/1985 | Daniel | 181/223 |
| 4,576,083 A | | 3/1986 | Seberger, Jr. | 89/14.4 |
| 4,726,280 A | | 2/1988 | Frye | 89/16 |
| 4,974,489 A | | 12/1990 | Fishbaugh | 89/14.4 |
| 5,279,200 A | | 1/1994 | Rose | 89/14.3 |
| 5,433,133 A | | 7/1995 | La France | 89/14.2 |
| RE35,381 E | | 11/1996 | Rose | 89/14.3 |
| 5,679,916 A | | 10/1997 | Weichert | 89/14.4 |
| 6,412,389 B2 | | 7/2002 | Fluhr | 89/14.4 |

FOREIGN PATENT DOCUMENTS

| | | | |
|---|---|---|---|
| DE | 316274 | | 10/1918 |
| DE | 28 24 546 A1 | | 12/1979 |
| DE | 33 37 417 A1 | | 4/1985 |
| DE | 42 31 183 C1 | | 3/1994 |
| DE | 199 35 929 C1 | | 2/2001 |
| EP | 0 579 306 A1 | | 1/1994 |
| FR | 0981733 | * | 5/1951 |
| FR | 1.142.032 | | 9/1957 |
| WO | WO 01/09560 A1 | | 2/2001 |

OTHER PUBLICATIONS

*International Preliminary Examination Report* corresponding to International application Ser. No. PCT/EP00/12305, European Patent Office, dated Apr. 23, 2002, 6 pages.

*International Search Report* with English–language translation, corresponding to International application Ser. No. PCT/EP00/12305, European Patent Office, dated Mar. 15, 2001, 6 pages.

* cited by examiner

*Primary Examiner*—Michael J. Carone
*Assistant Examiner*—Troy Chambers
(74) *Attorney, Agent, or Firm*—Grossman & Flight, LLC

(57) ABSTRACT

Methods and apparatus for fastening a silencer on to a firearm are disclosed. In an example, a mounting device is disclosed which includes a housing adapted to be mounted to the barrel such that the housing is fixed against rotation relative to the barrel. It also includes a silencer holder rotatably mounted to the housing; and a fastener to secure the silencer holder to the housing at an angular position that substantially maximizes the firing accuracy of the firearm.

12 Claims, 3 Drawing Sheets

METHODS AND APPARATUS FOR FASTENING A SILENCER ONTO THE BARREL OF A FIREARM

RELATED APPLICATION

This patent issued from a continuation-in-part application which claims priority under 35 U.S.C. §120 from International Patent Application No. PCT/EP00/12305, filed Dec. 6, 2000.

FIELD OF THE DISCLOSURE

This disclosure relates generally to firearms and, more particularly, to methods and apparatus for fastening a silencer onto the barrel of a firearm.

BACKGROUND

A mounting device is described in German patent application DE 199 35 929. The described mounting apparatus includes a tube-shaped silencer, a mounting socket attached to the back end of the silencer, and a gun muzzle that fits the mounting socket, to which the mounting socket can be affixed. In addition, DE 42 31 183 C1, U.S. Pat. No. 1,354,416, and especially DE 316 274 reflect the state of the art.

In one prior art device, a groove is defined in the outer surface of the muzzle. The mounting socket has a bar across it. When the mounting socket is pushed onto the muzzle, the bar snaps into the groove and secures the silencer in place. The silencer and its mounting socket can be rotated about the barrel after they are attached to the muzzle.

The mounting device can also be constructed so that it will fit on existing gun barrels whose muzzles were not designed with the goal of accommodating a silencer. In such circumstances, the mounting socket encircles the base of the front sight, somewhat like a bayonet. In this case, the mounting socket and silencer cannot be rotated around the muzzle. Unique™ manufactures a silencer of this type.

In a simple version, the mounting device has a threaded connection, with a male thread on the front end of the muzzle and a female thread in the mounting socket. Once the mounting socket is screwed onto the muzzle, neither the mounting socket nor the silencer can be rotated around the muzzle. Parker & Hale™ manufactures such a silencer.

Attaching a silencer to a handgun changes the bullet impact point. This is true because the attached silencer alters the barrel's oscillation behavior. In addition, the lengthwise axis of every barrel and silencer assembly has an individual deviation from true round. The silencer's deviation from round influences the flight path of a fired bullet.

DESCRIPTION OF THE PREFERRED EXAMPLES

Figure 1:
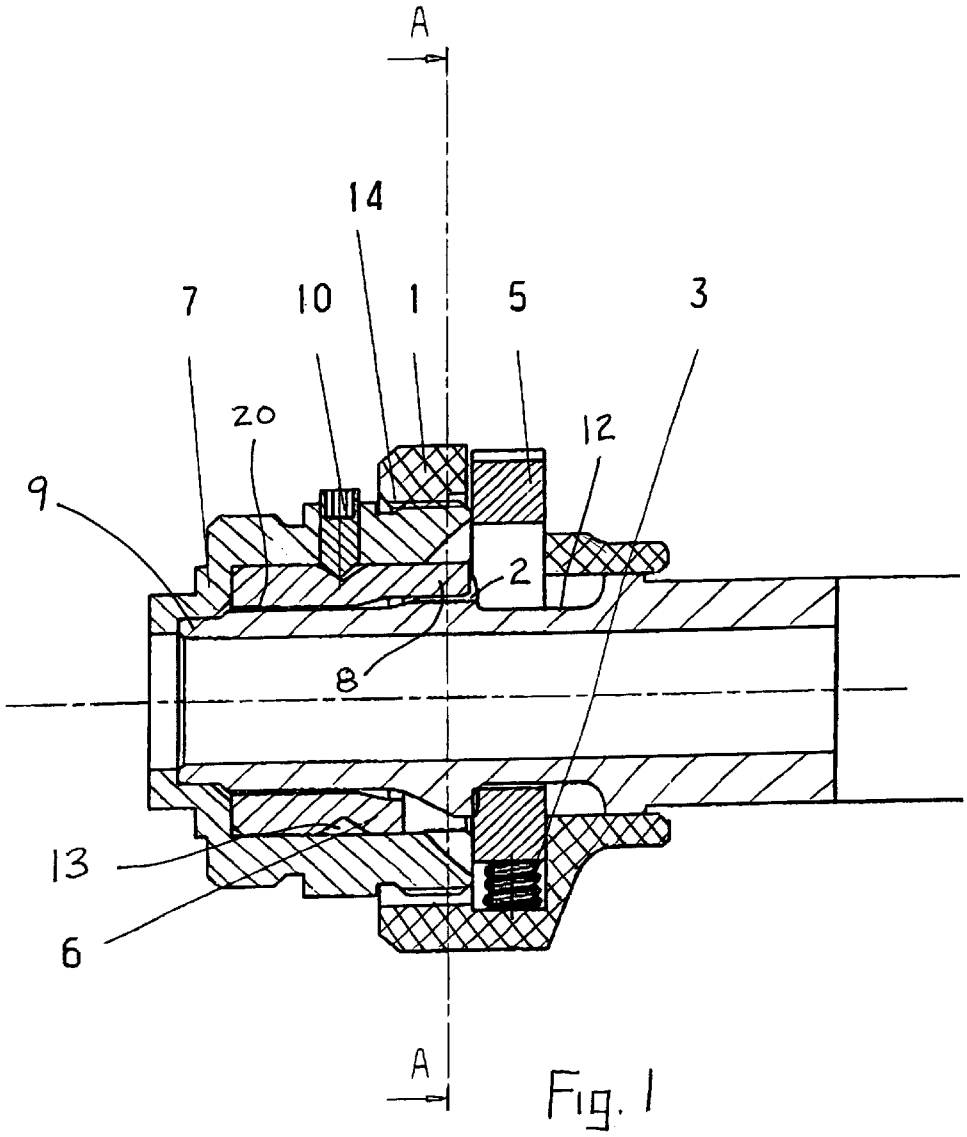
FIG. 1 is a lengthwise cross-sectional view through the muzzle area of a barrel with the mounting socket installed thereon.
Figure 2:
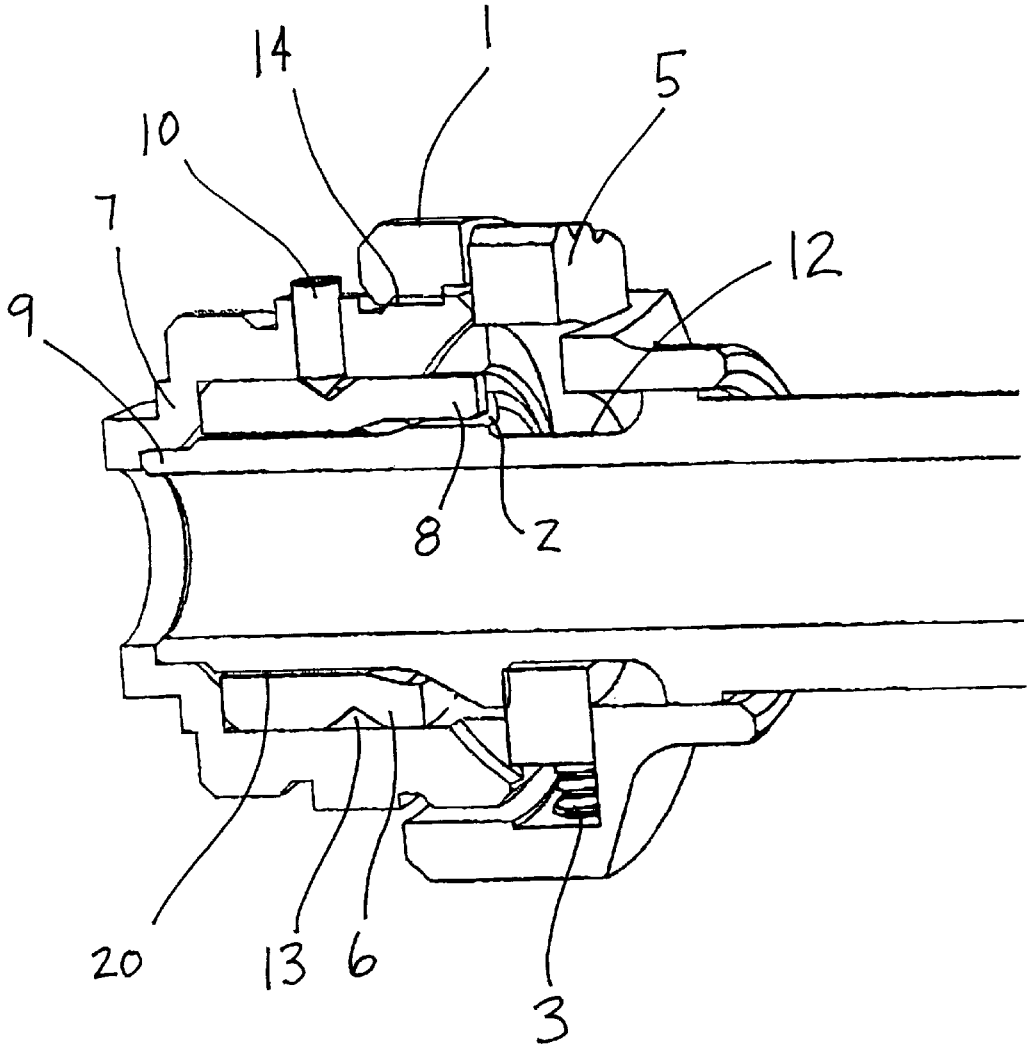
FIG. 2 is a cut away view in perspective of the muzzle area of the barrel with the mounting socket installed thereon.

FIG. 1 shows a schematic lengthwise cross-sectional view through the muzzle area of a barrel 9, while FIG. 2 shows the same area in a cut away perspective view. The shooting direction ("forward") is facing left in FIGS. 1 and 2. A silencer holder 7 has been slid onto the barrel 9 from front to back. The outer tube of a silencer (not shown) is screwed onto the holder 7. The silencer holder 7 contacts the front end of the muzzle on the barrel 9, forming a seal therewith.

More specifically, and referring to FIGS. 1 and 2, going from back to front, a sleeve 1 is screwed tightly onto an outer fine thread 14 formed on the forward portion of the holder 7 and can be fixed there if desired. A cross-slide 5 is attached to the sleeve 1 and is pushed radially outward by a pressure spring 3. The cross-slide 5 contacts the barrel 9 and is pressed by the spring 3 into a groove 12 formed around the outer surface of the barrel 9. This causes the beveled front surface of the cross-slide 5 to make firm contact with the front side edge of the groove 12 formed around the barrel 9, which ensures that the silencer holder 7 stays securely fastened to the barrel 9.

The silencer holder 7 can be rotated on the barrel 9 when attached. Rotating the holder 7 also rotates the silencer, the sleeve 1, and the cross-slide 5.

Figure 3:
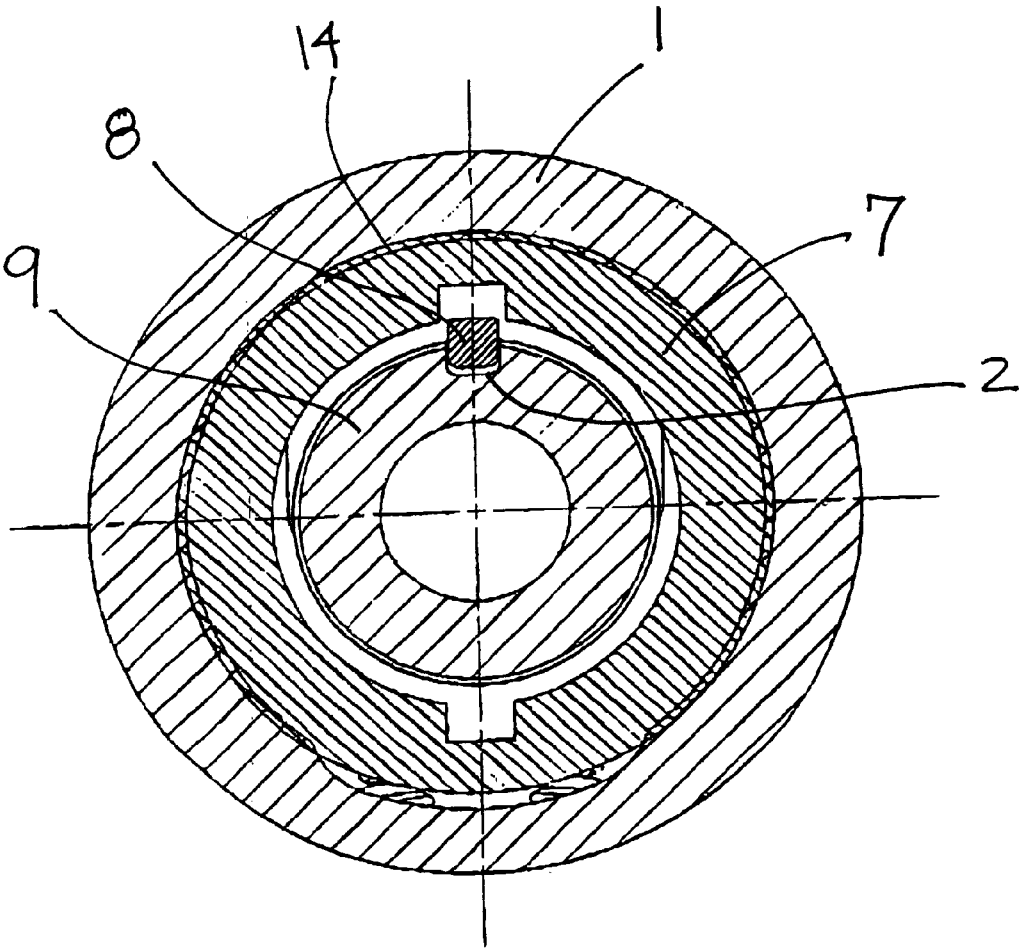
FIG. 3 is an enlarged cross-sectional view taken along line A—A of FIG. 1.

A cylindrical housing 6 is attached inside of the silencer holder 7. The housing 6 and the holder 7 are coaxial. The cylindrical housing 6 has an axial protrusion 8 on its back face. The protrusion 8 engages in a lengthwise groove 2, defined between round raised areas on the outer surface of the barrel 9. The protrusion 8 and the lengthwise groove 2 are also illustrated in FIG. 3, as are each of the sleeve 1, the holder 7, the barrel 9, and the thread 14 formed on the outward portion of the holder 7. When the silencer holder 7 is installed and secured on the firearm, the housing 6 cannot rotate on the barrel 9, because the protrusion 8 engages in the groove 2 and prevents the housing 6 from moving.

A bore with a female thread passes through the wall of the silencer holder 7. A headless hex socket screw 10 is screwed into the bore. This screw 10 has a tapered point that engages a groove 13 which is defined around the outer surface of the housing 6. The groove 13 has the same diameter as the tapered point of the screw 10, but it is displaced slightly backward with respect to the screw so that the screw 10 does not press the housing 6 forward when it is screwed in, the housing 6 contacts the inner shoulder of the silencer holder 7 with a strong friction force. At the same time the screw 10 is loaded crosswise, so that a strong friction force is also applied to its threads to secure it. In addition, the screw 10 can be locked in place with a center punch mark.

To calibrate the weapon with the silencer assembly mounted thereon, the silencer holder 7 is placed on the barrel 9. The screw 10 is then secured, a shot is fired and the impact point measured. The screw 10 is then loosened and the silencer holder 7 is rotated to and secured with the screw 10 in a new position where another shot is fired and the results measured. This process is repeated such that multiple shots are fired with the silencer holder 7 placed at different angles of rotation relative to the barrel 9. At the angle of rotation setting that results in the best shooting performance, more shots are fired with only very slight changes to the relative angle of rotation between the silencer holder 7 and the barrel 9, until a satisfactory bullet impact point is achieved. When that optimized performance state is achieved, the screw 10 is tightened down. After a final test shot, the screw 10 is permanently secured so that the silencer holder 7 is fixed to the barrel 9 in a position that produces optimum firing accuracy for the firearm/silencer combination.

If the silencer and the silencer holder 7 are removed from the weapon and then reinstalled without loosening the screw 10, it will have the same angle adjustment as it had immediately after it was calibrated.

From the foregoing, persons of ordinary skill in the art will appreciate that the disclosed mounting device is advantageous in that it reduces or eliminates the deviation in bullet impact point caused by attaching and/or reattaching a silencer mounting device. It should always be possible to achieve the optimum impact point, even when the silencer is removed from the gun and then replaced with no particular attention because the silencer can only be installed with the protrusion 8 located in the groove 2 and the screw 10 prevents rotation of elements 1 and 7 relative to the protrusion 8.

Tests with the previously described silencer mounting device, which can be rotated around the muzzle, surprisingly showed that the deviation in bullet impact point can be minimized by rotating the assembly. For every silencer and every gun to which it is attached, there is an optimum individual relative angle of rotation between the silencer and muzzle, where the impact point deviation is particularly small. The altered oscillation behavior and deviation from round of the muzzle and silencer probably come closest to compensating for each other at this optimum relative angle location.

In an example calibration process, the silencer and mounting device are first placed on the barrel 9 and then rotated until they snap into place on the barrel 9 (i.e., with a protrusion 8 of the housing 6 in the groove 2 and the cross-slide 5 engaging the barrel 9). The housing 6 is attached to the muzzle and cannot rotate around it, but the silencer holder 7 is rotatably attached to that housing 6. Thus, the silencer/mounting socket can be rotated relative to the muzzle. Next the optional relative angular position between the silencer/silencer holder 7 and the cylindrical housing 6/barrel 9 is found by measuring the bullet impact point with the silencer rotated to various positions and thereby determining the optimum bullet impact point. This range-finding procedure can easily be accomplished using a range-finding device. The silencer should be tube-shaped, because a silencer that is significantly asymmetrical with respect to the axis of the bore would weight the gun inconsistently in the various rotation positions, which would cause additional difficulties during the range-finding process.

After the optimum bullet impact point has been determined, then the holder 7 that holds the silencer can be attached to the non-rotating housing 6 in such a way that, even under heavy use no relative rotation will occur between the holder 7 and the housing 6. The silencer and the gun are now permanently adjusted to each other to produce optimal firing accuracy.

Once the range for the gun and silencer assembly has been found, the same gun and silencer must then be used together to achieve optimum firing accuracy. To this end, a clear marking system such as matching numbers should be employed. If the gun and silencer are delivered to the same individual customer, they will automatically stay together. If necessary, recalibration of the silencer and firearm assembly can easily be performed again, just as it can for the gun by itself after a major repair or for a similar reason.

From the foregoing, persons of ordinary skill in the art will appreciate that, by employing the foregoing device and/or calibration process, the bullet impact points for the weapon with and without the silencer substantially match each other, without requiring any greater precision when the silencer is manufactured.

The rotating silencer mounting device is preferably constructed such that the part 7 of the mounting socket fastened to the silencer is rotatably mounted on a non-rotating housing 6. The housing 6 which attaches to the muzzle with a preferably axial tongue-and-groove connector 8 after it is slid onto the muzzle to prevent rotation of the housing 6. In other words, this housing 6 is the non-rotating part of the mounting socket, around which the part 7 that holds the silencer can be attached and rotated.

The housing 6 has a tongue-and-groove connector including a protrusion 8 extending backward, asymmetrical relative to the housing 6. The connector 8 engages in a lengthwise groove 2 on the muzzle. Beveling the side edges of the protrusion 8 and lengthwise groove 2, and rounding the corners makes it easy to slide the housing 6 onto the muzzle.

The part 7 of the mounting socket that holds the silencer preferably seals around the muzzle and can in turn be rotated when attached to the weapon. This part 7 of the mounting socket also corresponds to the mounting socket of the previously mentioned mounting device. The aforementioned housing 6 does not reduce the power when shooting and, therefore, it can also encircle the barrel with some play. If it is clamped tight and therefore slightly distorted, it still does not press on the barrel and, therefore, does not create a new oscillation point. In addition, the housing's inner surface can be manufactured with less surface finishing and, therefore, more cheaply.

The space between the inner surface of the housing 6 and the outer surface of the muzzle connects to the sealing area between the part 7 of the mounting socket that holds the silencer, and the muzzle, and creates an expansion space 20 in case of a leak.

The illustrated device includes a radial set screw 10 in the part 7 of the mounting socket that engages the silencer, and its end engages a rounded groove 13 in the outer surface of the housing 6. The set screw 10 can be hardened and the housing 6 can be constructed of a relatively soft material, such as aluminum, so that the set screw "digs into" the housing 6 slightly when it is tightened.

The set screw 10 is preferably a socket hex screw, because more tightening and loosening torque can be applied to such a screw. When the silencer is calibrated, the set screw 10 can be secured by a drill bit or center punch mark, so that it cannot unlock by itself, for example when the gun is fired. For this application, the set screw 10 should be headless.

Persons of ordinary skill in the art will readily appreciate that the mounting device can be used with any type of hand-held firearm including rifles and machine guns, but is particularly well suited for use with a handgun.

Although certain apparatus and methods have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. For use with a generally cylindrical silencer and a firearm having a barrel, a mounting device for fastening the silencer to the barrel comprising:

a housing adapted to be fastened to the barrel at a predetermined angular position such that the housing is fixed against rotation relative to the barrel;

a silencer holder to engage the silencer, the silencer holder being rotatably mounted to the housing; and a fastener to selectively secure the silencer holder against rotation relative to the housing in any relative angular position between the silencer holder and the housing, wherein the fastener is a screw that engages the silencer holder and a circular groove defined around an outer surface of the housing.

2. A mounting device as defined in claim 1, wherein the housing is mounted on the barrel within the silencer holder.

3. For use with a generally cylindrical silencer and a firearm having a barrel, a mounting device for fastening the silencer to the barrel comprising:

a housing adapted to be fastened to the barrel at a predetermined angular position such that the housing is fixed against rotation relative to the barrel;

a silencer holder to engage the silencer, the silencer holder being rotatably mounted to the housing; and a fastener to selectively secure the silencer holder against rotation relative to the housing in any relative angular position between the silencer holder and the housing, wherein the housing is attached to the barrel via a tongue-in-groove connection.

4. For use with a generally cylindrical silencer and a firearm having a barrel, a mounting device for fastening the silencer to the barrel comprising:

a housing adapted to be fastened to the barrel at a predetermined angular position such that the housing is fixed against rotation relative to the barrel;

a silencer holder to engage the silencer, the silencer holder being rotatably mounted to the housing; and a fastener to selectively secure the silencer holder against rotation relative to the housing in any relative angular position between the silencer holder and the housing, wherein the housing cannot be rotated after it is mounted to the barrel.

5. For use with a generally cylindrical silencer and a firearm having a barrel, a mounting device for fastening the silencer to the barrel comprising:

a housing adapted to be fastened to the barrel at a predetermined angular position such that the housing is fixed against rotation relative to the barrel;

a silencer holder to engage the silencer, the silencer holder being rotatably mounted to the housing; and a fastener to selectively secure the silencer holder against rotation relative to the housing in any relative angular position between the silencer holder and the housing, wherein the housing includes a protrusion which extends asymmetrically backward and engages in a lengthwise groove defined on the barrel.

6. For use with a generally cylindrical silencer and a firearm having a barrel, a mounting device for fastening the silencer to the barrel comprising:

a housing adapted to be fastened to the barrel at a predetermined angular position such that the housing is fixed against rotation relative to the barrel;

a silencer holder to engage the silencer, the silencer holder being rotatably mounted to the housing; and a fastener to selectively secure the silencer holder against rotation relative to the housing in any relative angular position between the silencer holder and the housing, wherein the silencer holder forms a seal with the barrel, and wherein the housing and barrel define an expansion space therebetween.

7. For use with a silencer and a firearm with a barrel, a mounting device comprising:

a housing adapted to be mounted to the barrel at a predetermined angular position such that the housing is fixed against rotation relative to the barrel;

a silencer holder rotatably mounted to the housing; and a fastener penetrating at least one of the silencer holder and the housing to secure the silencer holder to the housing at an angular position that substantially maximizes the firing accuracy of the firearm, wherein the silencer holder is adapted to form a seal with the barrel.

8. For use with a silencer and a firearm with a barrel, a mounting device comprising:

a housing adapted to be mounted to the barrel at a predetermined angular position such that the housing is fixed against rotation relative to the barrel;

a silencer holder rotatably mounted to the housing;

a fastener penetrating at least one of the silencer holder and the housing to secure the silencer holder to the housing at an angular position that substantially maximizes the firing accuracy of the firearm; and a sleeve engaging the silencer holder, the sleeve being adapted to removably engage the barrel to permit removal of the mounting device from the firearm.

9. A mounting device as defined in claim 8, wherein the sleeve removably engages the barrel via a spring biased slide.

10. For use with a silencer and a firearm with a barrel, a mounting device comprising:

a housing adapted to be mounted to the barrel at a predetermined angular position such that the housing is fixed against rotation relative to the barrel;

a silencer holder rotatably mounted to the housing; and a fastener penetrating at least one of the silencer holder and the housing to secure the silencer holder to the housing at an angular position that substantially maximizes the firing accuracy of the firearm, wherein the housing is annular and an inner diameter of the housing is dimensioned to define an expansion space between the housing and the barrel.

11. A mounting device as defined in claim 7, wherein the fastener comprises a screw.

12. A mounting device as defined in claim 1, wherein the fastener secures the silencer holder to the housing at a position such that bullet impact points associated with the firearm are substantially the same when the silencer is attached to the barrel via the mounting device and when the mounting device is not mounted to the barrel.

* * * * *